United States Patent [19]

Tait et al.

[11] Patent Number: 4,933,824

[45] Date of Patent: Jun. 12, 1990

[54] ILLUMINATED PANEL

[75] Inventors: Robert J. Tait, Toronto, Canada; Simon G. A. Perutz, Evanston, Ill.

[73] Assignee: Nimlok Company, Niles, Ill.

[21] Appl. No.: 299,044

[22] Filed: Jan. 19, 1989

[51] Int. Cl.[5] ..... F21L 15/08

[52] U.S. Cl. ..... 362/362; 362/125; 362/388; 362/450

[58] Field of Search ..... 362/125, 126, 145, 147, 362/362, 364, 388, 450

[56] References Cited

U.S. PATENT DOCUMENTS

| | | | |
|---|---|---|---|
| 1,595,194 | 8/1926 | Hotchkin | 362/145 |
| 3,231,996 | 2/1966 | Krauss | 40/571 |
| 4,490,776 | 12/1984 | Kluch | 362/450 |

FOREIGN PATENT DOCUMENTS

| | | | |
|---|---|---|---|
| 341004 | 5/1904 | France | 362/450 |

*Primary Examiner*—Stephen F. Husar

*Assistant Examiner*—Sue Hagarman

*Attorney, Agent, or Firm*—Neuman, Williams, Anderson & Olson

[57] ABSTRACT

An illuminated panel is provided for use in a display panel system. The illuminated panel includes a frame having opposed peripheral segments which delimit a predetermined area. A cover piece of a material pervious to light rays is mounted on the front side of the frame and overlies the predetermined area. A collapsible housing adjustable between operative and inoperative modes, is mounted on the back side of the frame and includes a pair of foldable wall sections having first portions connected to first opposed peripheral segments of the frame. When the housing is in the operative mode, second portions of the wall sections extend angularly rearwardly from the frame back side and cooperate to form a cavity for accommodating a removable light source. When the housing is in the inoperative mode, the wall sections are disposed in proximate overlying relation with the cover piece.

13 Claims, 3 Drawing Sheets

FIG.1
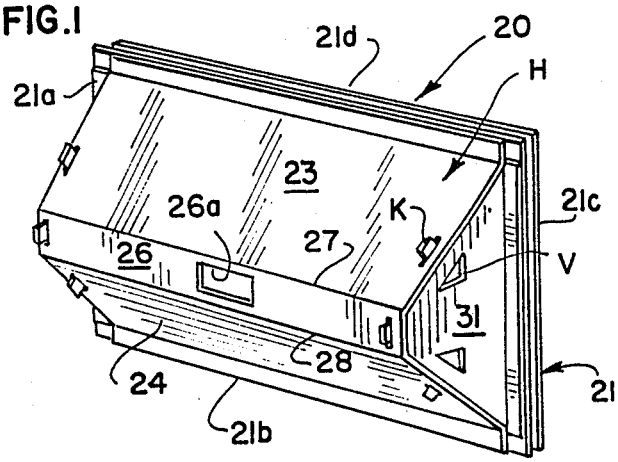
FIG.3
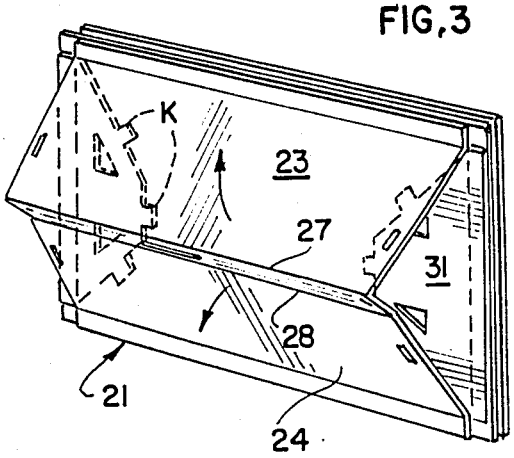
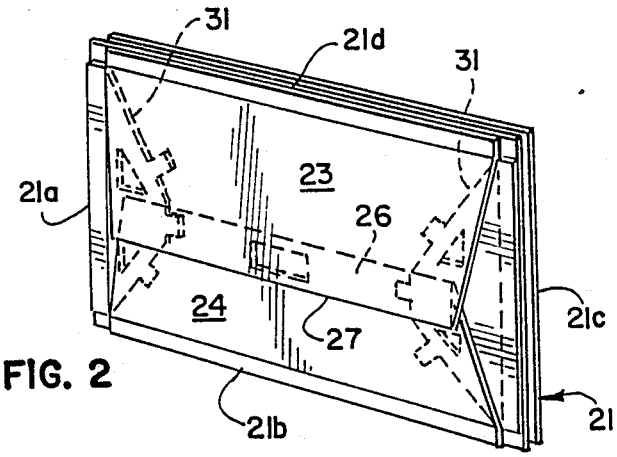
FIG. 2
FIG. 4
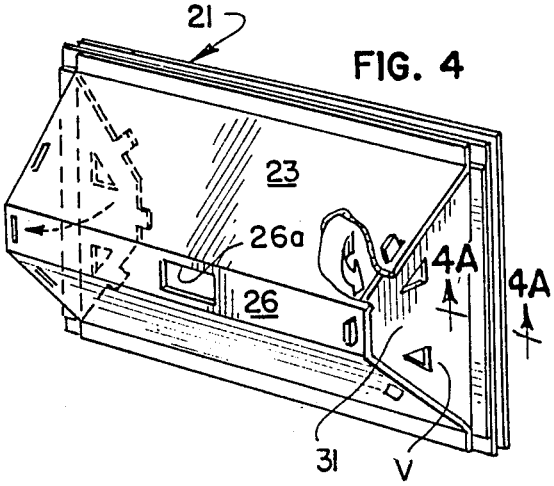
FIG. 2A
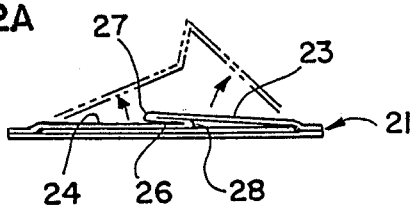
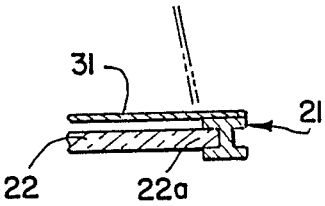
FIG. 4A
FIG. 5
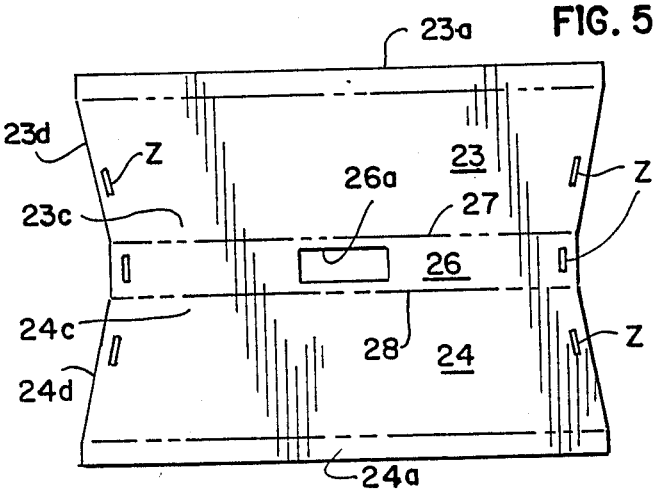
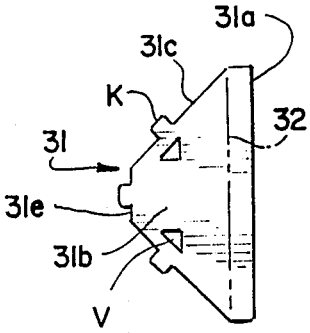
FIG. 6

FIG. 11
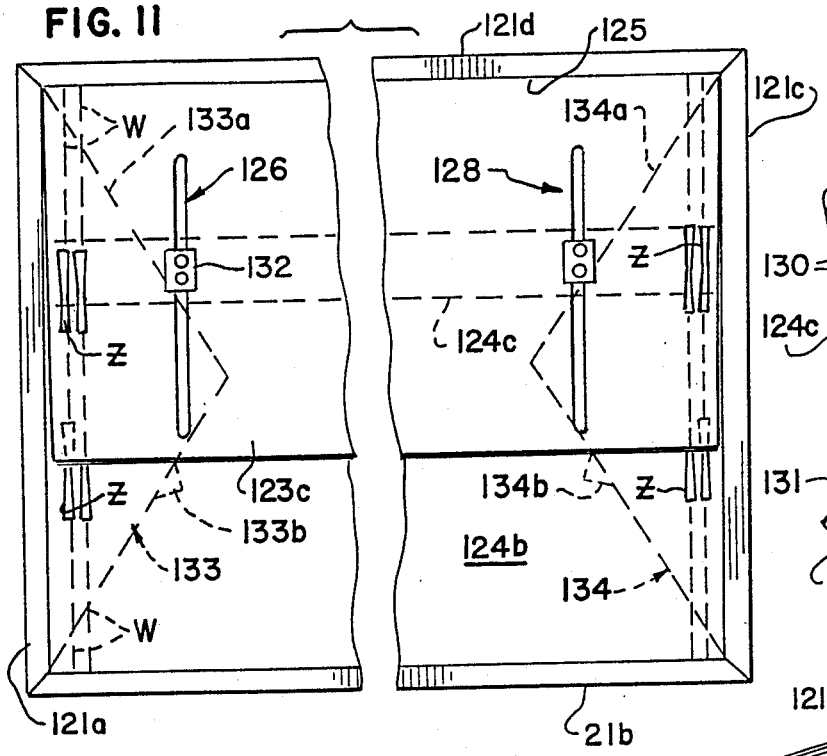
FIG. 14
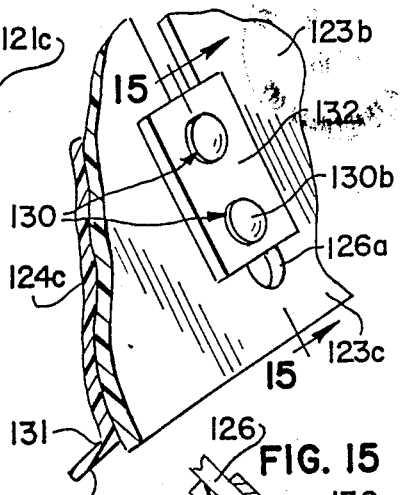
FIG. 15
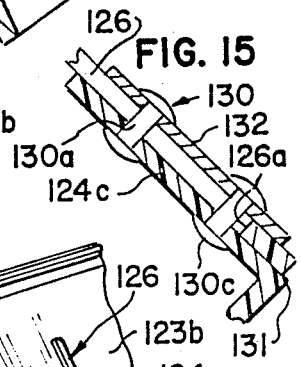
FIG. 12
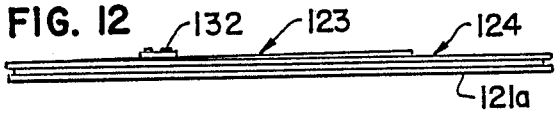
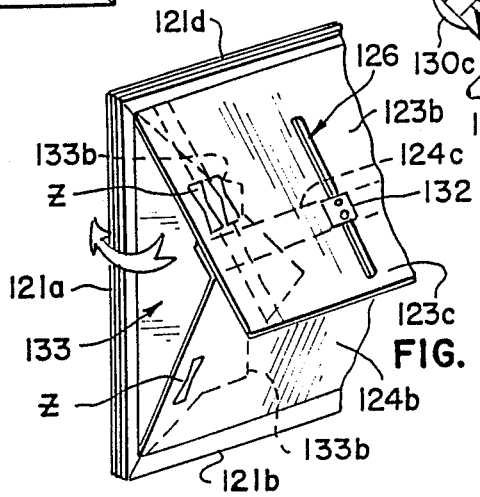
FIG. 13
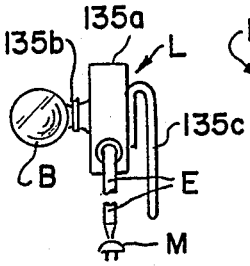
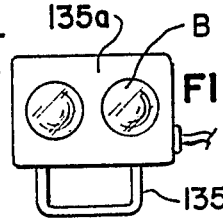
FIG. 16
FIG. 17
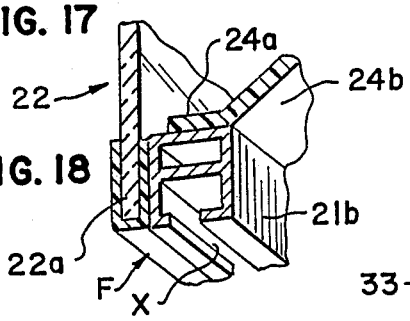
FIG. 18
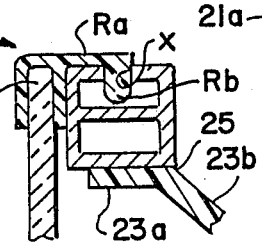
FIG. 19
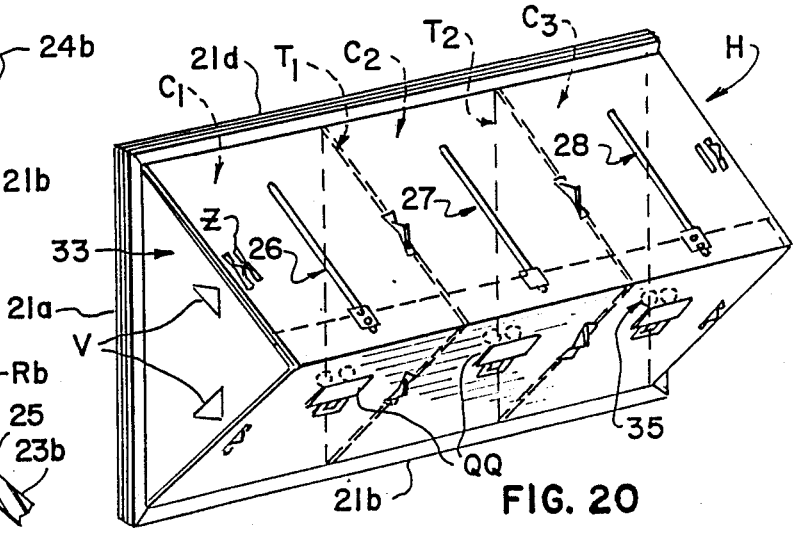
FIG. 20

ILLUMINATED PANEL

BACKGROUND OF THE INVENTION

Foldable display systems are widely used as temporary structures at trade fairs, retail stores and the like for marketing various products or promoting various services provided by a company, organization or institution. Such display systems must have an attractive, eye-catching appearance; must be stable when set up; must be easily assembled and disassembled; and when in a disassembled state, form a compact unit suitable for storage or being transported.

Various display systems embodying these virtues have heretofore been available; however, where one or more of the display panels incorporated in the prior systems is to be illuminated, such systems are beset with one or more of the following shortcomings: (a) the illuminated panel is of a complex and costly construction incapable of forming a compact unit when disassembled from other display panels comprising the system; (b) the illuminated panel is bulky and heavy and is awkward and difficult to manually handle when being assembled with or disassembled from other display panels of the system; (c) the lighting source providing the desired illumination is permanently attached to the illuminated panel and is not readily accessible for servicing or maintenance; (d) the intensity of the illumination desired cannot be readily changed; (e) connection of the light source to a power supply requires the services of a licensed electrician.

SUMMARY OF THE INVENTION

The improved illuminated panel avoids all of the aforenoted shortcomings associated with panels of this general type.

The improved illuminated panel may be readily incorporated in a display system at any desired location.

The improved illuminated panel does not require any special electrical fittings or a special source of electrical power for the light source incorporated in the panel.

The light rays emitted from the light source incorporated in the improved panel may be readily diffused throughout or through selected portions of the exposed cover piece forming a component of the panel.

The light source incorporated in the improved panel may utilize standard, inexpensive incandescent bulbs and conventional sockets therefor.

The components comprising the collapsible housing for the improved panel may be readily utilized with a panel frame which varys in size and shape over a wide range.

Further advantages of the invention will become apparent from the description, accompanying drawings and appended claims.

In accordance with one embodiment of the invention, an improved illuminated panel is provided which is adapted to be used with other panels to form a foldable display system. The illuminated panel includes a frame which delimits a predetermined area. Overlying the area and affixed to the front side of the frame is a cover piece of a material which is pervious to light rays emitted from a light source, the latter being disposed behind the cover piece. Affixed to the back side of the frame is a collapsible housing which is adjustable between operative and inoperative modes. The housing includes a pair of wall sections having first portions connected to first opposed peripheral segments of the frame. When the housing is in the operative mode, the wall sections extend angularly rearwardly from the frame back side, and corresponding second portions of the wall sections are interconnected whereby the wall sections define a cavity which is adapted to removably accommodate one or more light sources. When the housing is in an inoperative mode, the wall sections assume a collapsed overlapping relation and are in proximity to an interior surface of the cover piece.

DESCRIPTION

For a more complete understanding of the invention reference is made to the drawings wherein:

FIG. 1 is a perspective rear view of a preferred embodiment of the improved illuminated panel showing the housing thereof in an operative mode.

FIG. 2 is similar to FIG. 1 but showing the housing thereof in an inoperative mode.

FIG. 2A is an end elevational view of the panel of FIG. 2 and showing in phantom lines the housing thereof in a partially set up condition.

FIG. 3 is similar to FIG. 2 but showing the housing thereof in a partially set up condition.

FIG. 4 is similar to FIG. 3 but showing the housing thereof in a further stage of set up.

FIG. 4A is an enlarged fragmentary sectional view taken along line 4A—4A of FIG. 4.

FIG. 5 is a top plan view of a blank per se which includes the wall and central sections of the housing, shown in FIG. 1.

FIG. 6 is a plan view of one of the support members per se included in the housing shown in FIG. 1.

FIG. 11 is like FIG. 10 but showing the housing thereof in an inoperative, or collapsed, mode.

FIG. 12 is a left side elevational view of the panel of FIG. 11.

FIG. 13 is a fragmentary perspective back view of the panel of FIG. 11 with the housing components thereof being adjusted relative to one another so that the housing will assume an operative mode.

FIG. 14 is an enlarged fragmentary perspective view showing the slidable interconnection between portions of the wall sections.

FIG. 15 is a sectional view taken along line 15—15 of FIG. 14.

FIGS. 16 and 17 are front and right side elevational views, respectively, of one form of a light source removed from the panel housing.

FIG. 18 is an enlarged fragmentary perspective sectional view of a third embodiment of the illuminated panel and showing a peripheral portion of the cover piece being accommodated in a track section, the latter being a part of the frame bottom section.

FIG. 19 is similar to FIG. 18 but showing the upper peripheral portion of the cover piece being accommodated by a retainer element removably mounted on the frame top section.

FIG. 20 is a fragmentary rear perspective view of a fourth embodiment of the improved panel.

Figure 7:
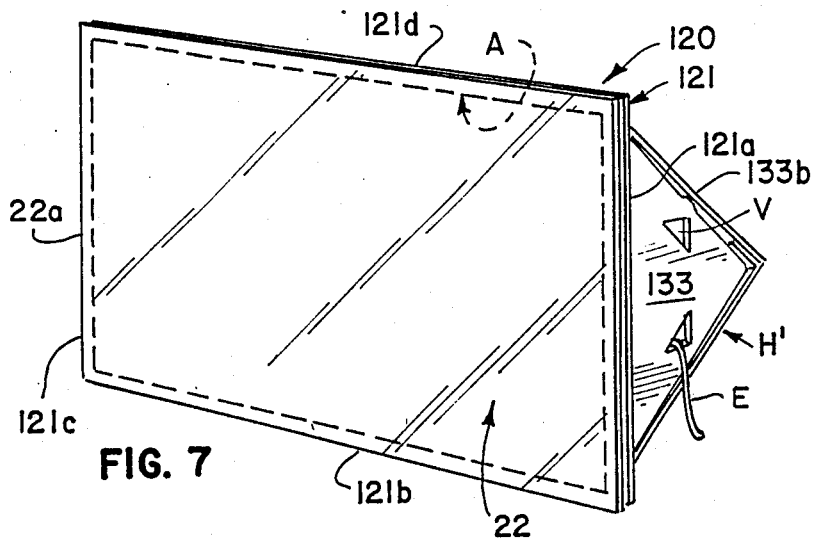
FIG. 7 is a fragmentary perspective front view of a second embodiment of the illuminated panel per se and showing the housing thereof in an operative mode.
Figure 8:
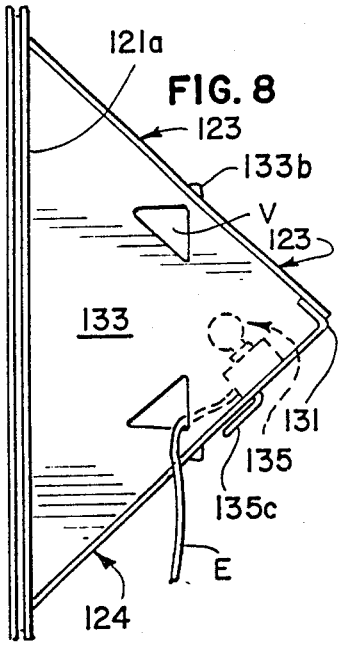
FIG. 8 is a right side elevational view of the panel of FIG. 7.

Referring now to the drawings and more particularly to FIGS. 1-5, an improved illuminated panel 20 is shown which is adapted to form a part of a foldable display system of a type used by exhibitors at trade fairs, or retailers at supermarkets or by others for marketing or promoting various products or services. Such display systems normally include a plurality of upright panels, not shown, foldably interconnected along their edges so that they may be angularly arranged to form partitions or booth-like structures. The illuminated panel 20 to be hereinafter described may be substituted for one of the regular display panels of the system or may be added to and interfit with said regular panels so as to expand the system and make it more attractive and eye appealing by highlighting certain segments of the partition or booth like structure with graphics or images, such as enlarged transparencies.

Panel 20 includes a frame 21 formed of a plurality of interconnected sections 21*a–d* preferably extruded from a suitable lightweight metal or plastic. The frame, as illustrated, has a quadrilateral configuration whereby sections 21*a* and 21*c* are in opposed substantially parallel relation and form the upright sides of the panel. Frame sections 21*b* and 21*d* are also in opposed substantially parallel relation and form the bottom and top segments, respectively, of the panel. If desired, panel 20 may be turned 90° so that frame sections 21*b* and 21*d* extend upright rather than in a horizontal direction.

Each frame section preferably includes an exposed, laterally facing elongated slot X (FIG. 19) which is adapted to accommodate longitudinally spaced link pieces, not shown, for attaching the illuminated panel to adjacent panels, the latter being disposed above, below and/or to the side of the illuminated panel 20. The link pieces may be of the hinge type shown in pending U.S. application Ser. No. 057382 filed June 2, 1987. The types of link piece and frame sections utilized may vary over a wide range and form no part of the invention hereinafter disclosed. The frame sections 21*a–d* coact to delimit a predetermined area A, see FIGS. 3 and 7. Mounted on the frame 21, normally the front side, is a cover piece 22 which completely overlies the area A. If the frame is to be concealed, when the panel 20 is assembled in the display system, the cover piece 22 is sized so that peripheral portions 22*a* thereof will overlie the entire front side of the frame and be secured thereto by suitable adhesive, Velcro strips, or magnetic tape, see FIG. 7.

Where total concealment of the frame is not essential when viewing the panel 20 from the front side, U-shaped track sections, or channels, F may be mounted on the front side of frame sections 21*a–c*, see FIGS. 18 & 19. Each track section may be substantially coextensive with the frame section on which it is mounted. The peripheral portions 22*a* of the cover piece 22 are slidably accommodated within the track sections. Once the cover piece is accommodated in the track sections F, a retainer element R, FIG. 19, may be positioned over the remaining peripheral portion 22*a* of the cover piece whereby a laterally extending arm Ra of the retainer element, which has a depending flange Rb formed on the distal end thereof may be snapped into engagement with the slot X formed in frame section 21*d*. Once the retainer element R is assembled on the frame section 21*d*, the cover piece is effectively secured to the frame 21. The track sections F may be used when the cover piece is formed of a relatively stiff material which is lightweight, strong, pervious to light rays and on which graphics may be readily applied. In lieu of the track sections and retainer element, threaded fasteners may extend through the cover piece peripheral portions and be threaded into the front face of the frame section 21*a–d*.

Mounted on the back side of frame 21 is a collapsible housing H which is adjustable between operative (FIG. 1) and inoperative (FIGS. 2 and 2A) modes. Housing H includes a pair of wall sections 23, 24, which have marginal first portions 23*a*, 24*a* thereof mounted, respectively, on the back sides of frame sections 21*d* and 21*b*. Adhesive or fasteners may be utilized to secure the portions 23*a*, 24*a* to the frame 21. Each first portion 23*a*, 24*a* is connected by a foldline 25 to a corresponding second portion 23*b*, 24*b* of the wall section. As seen in FIGS. 1 and 5, the outer edge portions 23*c*, 24*c* of the wall sections 23, 24 are interconnected by an elongate narrow connecting or central section 26 which has a rectangular configuration. The elongate edges of section 26 are connected by foldlines 27, 28 to respective outer edge third portions 23*c*, 24*c* of the wall sections. Foldline 27 allows section 26 to fold under wall section 23 and foldline 28 allows section 26 to fold over wall section 24, when the housing H is in collapsed inoperative mode, see FIGS. 2 and 2A. When the housing H is in the operative mode, FIG. 1, the second portions 23*b*, 24*b* of wall sections 23, 24 converge rearwardly from the frame 21 to the central section 26, which in turn is disposed in spaced, substantially parallel relation to the cover piece 22 mounted on frame 21. Central section 26 is provided with an access opening 26*a* for a light source, shown in FIGS. 16 and 17 and to be described more fully hereinafter. Additional openings may be formed in central section 26 or one or more, access openings may be formed in the wall section second portions, if desired. The side edge segments 23*d*, 24*d* of the second portions of the wall sections 23, 24 and the end edge segments of the central section 26 may be provided with locking slots Z which are in endwise alignment and adjacent the side and end edges of the wall and central sections. As seen in FIG. 5 the wall sections and central section of housing H may be of unitary construction, that is to say, formed from a single piece of sheet material.

Secured to the back side of frame sections 21*a*, 21*c* are support members 30, 31. The support members are of like configuration and only support member 31 to be hereinafter described is shown in FIG. 6. Each support member has a substantially triangular configuration. A marginal first segment 31*a* is secured by adhesive or fasteners to the back side of frame section 21*c* or 21*a*. First segment 31*a* is connected by a foldline 32 to one side of a second segment 31*b*, the latter being defined in part by converging side edges 31*c*, 31*d* which extend from opposite ends of segment 31*a*, and an angularly disposed distal edge 31*e*. Each of the edges is provided with a locking tab K which is adapted, when the housing H is in the operative mode, to extend through and releasably interlock with a corresponding slot Z formed in the wall and central sections. Vents V may be formed in the second segment of each support member, if desired.

The housing H may be easily and quickly adjusted manually to either the operative or inoperative mode. When in the inoperative mode, the locking tabs K are disengaged from the corresponding locking slots Z thereby allowing the support members 30, 31 to be folded inwardly towards one another so as to overlie in close proximity the back or concealed side of the cover piece 22. Once the support members have been adjusted to such positions, the wall and central sections are free to be folded relative to one another so as to overlie in close proximity the previously folded support members, see Figs. 2 and 2A. By reason of the foldlines 27 and 28 connecting the central section 26 to the wall sections 23, 24, wall section 24 will automatically fold inwardly ahead of wall section 23 causing central section 26 to fold under wall section 23, see FIG. 3, and be sandwiched between the wall sections A second embodiment of the improved illuminated panel 120 is shown in FIGS. 7–15. The primary difference between panels 20 and 120 resides in the housing structure. In panel 121, the housing H' includes a pair of wall section 123, 124, each having a first portion, 123*a*, 124*a* secured to a corresponding frame section 121*d*, 121*b* in a manner as previously described with regard to panel 20. Each portion 123*a*, 124*a* is connected by a foldline 125 to a corresponding second portion 123*b*, 124*b* of the wall section; the second portions, in turn, are interconnected as hereinafter described.

Figure 9:
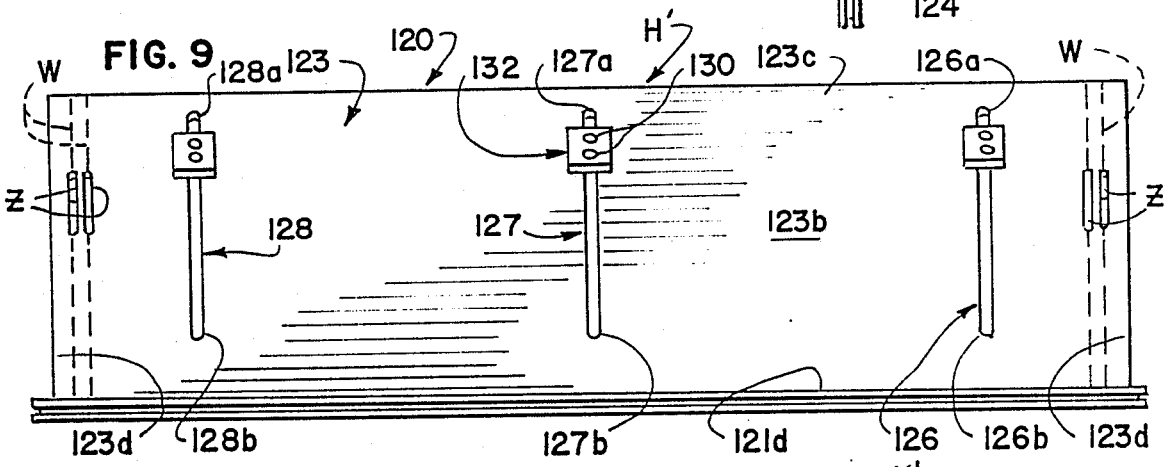
FIGS. 9 and 10 are top and back views, respectively, of the panel of FIG. 7.
Figure 10:
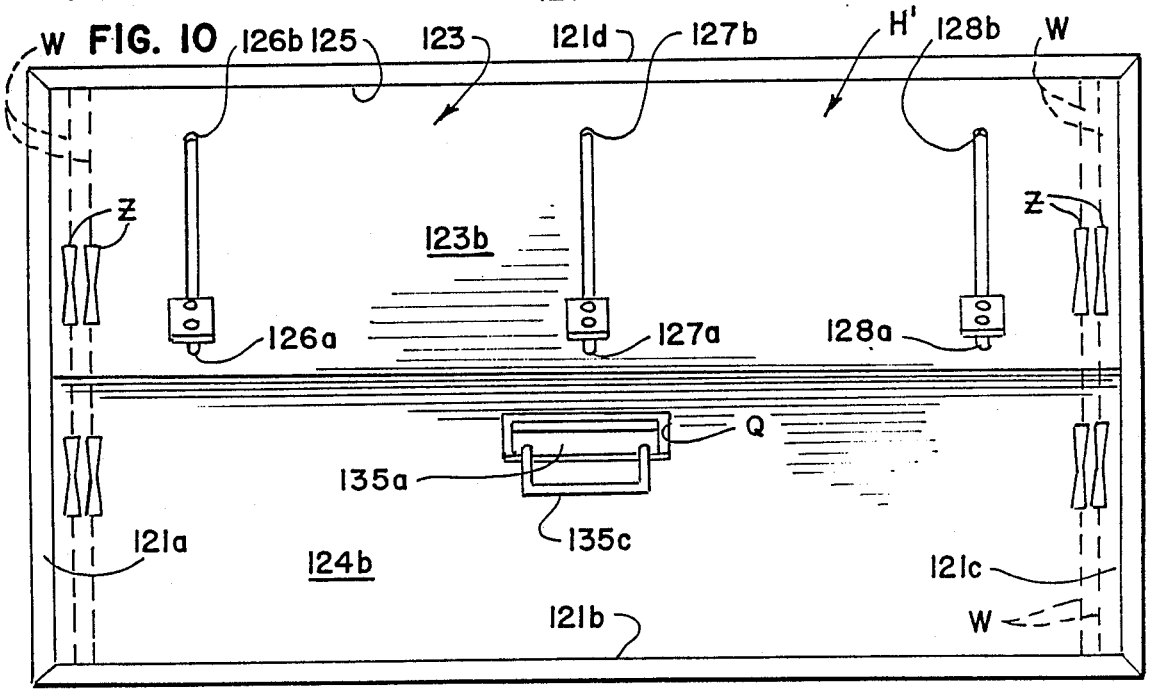

As seen in FIGS. 9–11, wall section 123 is provided with a plurality of laterally spaced, parallel, elongate slots 126, 127, 128, each having one end 126*a*, 127*a*, 128*a* thereof disposed adjacent a marginal portion 123*c*, the latter being opposite first portion 123*a*. The opposite end 126*b*, 127*b*, 128*b* of each slot is in proximity to foldline 125. Each slot is disposed substantially perpendicular to foldline 125.

Disposed within each slot is a shank 30*a* of one or more studs 130, see FIG. 15. One end of the shank extends through an opening formed in a third portion 124*c* of wall section 124 and terminates in an enlarged head 130*b*. The third portion 124*c* is connected to second portion 124*b* of wall section 124 by a foldline 131, see FIG. 15. Foldlines 125 and 131 are disposed in spaced, parallel relation. The enlarged head 130*b* engages and subtends the underside of portion 124*c*.

The opposite end of shank 130*a* extends through an opening formed in a slide piece 132 and terminates in an enlarged head 130*c*, which engages and overlies an exposed surface of the slide piece. The slide piece has a width which is greater than the width of the adjacent slot. Where two studs are provided for each slot 126, 127, 128, the openings in the slide piece are in alignment with corresponding openings in the wall section third portion 124*c* and thus, maintain the shanks 130*a* in parallel relation as they move along the length of the slot. The movement of the stud shanks 130*a* within the slots 126–128 occurs when the housing H' is being manually adjusted between the operative and inoperative modes.

If desired, each wall section 123, 124 may be provided with one or more scorelines W which are spaced from and substantially parallel to a marginal edge segment 123*d*, 124*d* of the wall sections. The scorelines W facilitate reducing the widths of the wall sections, if necessary, to conform to the length of the frame sections 121*b*, 121*d*. Similar scorelines, not shown, may be provided along the side edge segments of the piece of sheet material shown in FIG. 5.

Foldably connected to frame sections 121*a* and 121*c* are support members 133, 134 which, as illustrated, have like triangular configurations. When the housing H'0 is in the operative mode, the support members are folded to substantially perpendicular positions with respect to the cover piece 122 and serve to maintain wall sections 123, 124 in predetermined, angular, rearwardly extending relative positions. The two rearwardly extending edges 133*a*, 134*a* of the support members 133, 134 are provided with tabs 133*b*, 134*b* which are adapted to interlockingly engage corresponding openings Z formed along marginal edge segments 123*d*, 124*d* of wall sections 123, 124. When the support members 133, 134 are in interlocking engagement with the wall sections 123, 124, a cavity is formed which is enclosed on one side by the cover piece 22. The support members may be provided with ventilating ports V which communicate with the cavity.

Disposed within the cavity and removably mounted on one of the wall sections is a light source L. In the panel 120 shown in FIGS. 7–11, an access opening Q is provided in wall section 124 in proximity to the foldline 131 connecting portions 124*b* and 124*c*. The access opening Q is approximately equidistant from frame sections 121*a*, 121*c*. In panel housing H, the central section 26 is provided with the centrally located access opening 26*a*.

The light source as illustrated in FIGS. 16 and 17 includes a socket base 35*a* on which a pair of conventional sockets 35*b* are mounted on the front face thereof for receiving standard incandescent bulbs B. The number of sockets on the base may be greater, or less, than shown. Projecting from one end of the base is an electrical cord E, which extends through the access opening and has a conventional male plug M at the free end for interfitting in a wall or floor socket, not shown. Affixed to the back side of the base 135*a* is a spring clip 135*c* which is adapted to straddle a peripheral portion of the access opening 26*a* or Q and retain the light source L in a selected location. The light source is mounted within the cavity only after the housing has assumed its operative mode and is disassembled from the central section 26 or wall section 124 before the housing is adjusted to its inoperative mode.

The wall sections 23, 24, 123, 124, central section 26, and support members 30, 31, 133, 134 are preferably formed of either a relatively stiff, opaque, plastic sheet material (e.g. polyethylene or polypropylene), corrugated fiberboard, or a similar material which retains its shape whether in a folded or unfolded state. In addition, such material should be moisture-proof, non-flammable and capable of withstanding abusive handling which normally occurs during transporting or storage of the panel, or when the illuminated panel is being assembled with or disassembled from other panels in a display system.

While the support members 30, 31 and 133, 134 are shown foldably connected to frame sections 21*a*, 21*c*, and 121*a*, 121*c*, it may be preferred, in some instances, to have such members foldably connected to the marginal side edges 23*d*, 24*d*, or 123*d*, 124*d* of the wall sections. In such a modified support member, only one locking tab may be provided on the non-foldably connected edge of each support member. The edge of the modified member adjacent the frame sections 21*a*, 21*c* would merely rest against the interior surface of the cover piece in the vicinity of the frame sections or the back side of the frame.

Furthermore, as seen in FIG. 20 the housing interior may be partitioned into a plurality of subcavities, C1, C2, C3 by removable light shielding partitions T1, T2 which may be installed prior to the support members 30, 31 or 133, 134 being folded to their rearwardly extending positions when the housing is being adjusted to the operative mode. The partitions T1, T2 may have a shape similar to the support members 30, 31 or 133, 134 except that the edges thereof adjacent the cover piece rest against the interior surface of cover piece. Each subcavity may have an access opening formed in central section 26 or wall section 124. A separate light source may be removably mounted within each subcavity. The light sources may, if desired, be of different intensities or color and may be energized simultaneously or sequentially to give a particular visual effect.

The size and shape of the frame and housing may vary from that shown and will depend in part on the type of display system to be utilized and the location of the illuminated panel within the display system.

When any of the afore-described illuminated panels is in the inoperative mode, the panel has a flat thin configuration, thereby rendering such panel suitable for storage or transporting, alone, or arranged in stacked relation with other panels comprising the display system. As aforementioned, the illuminated panel in each instance is light weight and thus, may be manually carried, if desired, when the housing is in the inoperative mode. The improved illuminated panel is of simple, inexpensive construction; requires a minimum amount of manual labor to set up or dismantle; may readily interfit with other panels incorporated in a display system; and is capable of simultaneously or sequentially illuminating a variety of images to produce a desired visual effect.

We claim:

1. A portable illuminated panel for use in a display panel system, comprising a substantially rigid frame having opposed peripheral segments delimiting a predetermined area; a cover piece mounted on said frame and overlying said predetermined area, at least a portion of said cover piece being pervious to light rays; and a collapsible housing mounted on a back side of said frame and adjustable between operative and inoperative modes, said housing including a pair of wall sections having first portions fixedly connected to first opposed peripheral segments of said frame, second portions connected by first foldlines to the corresponding first portions, means spaced from said first portions and interconnecting said second portions, and foldable support members disposed adjacent second opposed peripheral segments of said frame; when said housing is in the operative mode, said wall section second portions and said support members being interconnected and projecting rearwardly from said frame back side and cooperating with one another and said cover piece to form a cavity for a light source; when said housing is in the inoperative mode, said wall section second portions and said support members being folded inwardly relative to one another into overlying proximate relation with said cover piece and disposed substantially within the predetermined area of said frame.

2. The illuminated panel of claim 1 wherein the housing is formed of an opaque, lightweight, relatively stiff-sheet material.

3. The illuminated panel of claim 1 wherein the housing, when in the operative mode, is provided with an access opening to the cavity for removably accommodating a light source; said opening being spaced rearwardly from the cover piece when said housing is in the operative mode.

4. The illuminated panel of claim 1 wherein each support member has a first edge portion thereof foldably connected to a second peripheral segment of the frame.

5. The illuminated panel of claim 1 wherein the frame thereof is provided with means whereby said frame is attachable to an adjacent display panel included in the system.

6. The illuminated panel of claim 1 wherein the housing cavity is provided with removable light shielding partition means forming said cavity into a plurality of subcavities; each subcavity being adapted to accommodate a removable light source.

7. The illuminated panel of claim 1 wherein the support members and at least one of said wall sections are provided with complementary locking means which interlock with one another when said housing is in an operative mode; a predetermined number of said complemental locking means including peripheral tabs and a corresponding number of said complemental locking means including apertures sized to lockingly accommodate said tabs.

8. The illuminated panel of claim 7 wherein the peripheral tabs are provided on the support members and the apertures are disposed adjacent corresponding side edge portions of the wall section second portions.

9. The illuminated panel of claim 1 wherein the means interconnecting the wall section second portions includes an elongate connecting section having opposed peripheral segments connected by substantially parallel second foldlines to corresponding second portions.

10. The illuminated panel of claim 9 wherein the first and second foldlines are substantially parallel to one another and the connecting section is folded under one of the wall section second portions and is sandwiched between said wall section second portions when the housing is in an inoperative mode.

11. The illuminated panel of claim 9 wherein the wall sections and the connecting section are of unitary construction.

12. The illuminated panel of claim 9 wherein the means interconnecting the wall section second portions includes elongate guide means formed in one wall section second portion and extending substantially perpendicular to the folding connection between the one wall section first and second portions, the other wall section having a third portion opposite the first portion and foldably connected to the second portion of said other wall section, said third portion being provided with a complemental element slidably disposed within said guide means; said element being adjacent one end portion of said elongate guide means, when said housing is in the operative mode, and being adjacent a second end portion of said elongate guide means when said housing is in the inoperative mode.

13. The illuminated panel of claim 12 wherein the guide means includes a predetermined number of elongate slots disposed in spaced, substantially parallel relation; the complemental element includes a plurality of stud-like elements, at least one for each slot, each element having a shank slidably disposed within a corresponding slot, first means disposed at one side of the slot for affixing one end of the shank to said other wall section second portion, and second means disposed at an opposite side of the slot and affixed to a second end of said shank, said second means being impassable relative to the slot.

* * * * *